US009937712B2

(12) United States Patent
Nozawa

(10) Patent No.: US 9,937,712 B2
(45) **Date of Patent: *Apr. 10, 2018**

(54) LIQUID EJECTING APPARATUS AND HEAD UNIT

(71) Applicant: Seiko Epson Corporation, Tokyo (JP)

(72) Inventor: Dai Nozawa, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/587,807

(22) Filed: May 5, 2017

(65) Prior Publication Data

US 2017/0239942 A1 Aug. 24, 2017

Related U.S. Application Data

(63) Continuation of application No. 15/235,624, filed on Aug. 12, 2016, now Pat. No. 9,669,621.

(30) Foreign Application Priority Data

Aug. 27, 2015 (JP) ..... 2015-167519

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
CPC .. B41J 2/04541; B41J 2/0455; B41J 2/04581; B41J 2202/11
See application file for complete search history.

(56) References Cited

U.S. PATENT DOCUMENTS

| | | | |
|---|---|---|---|
| 9,375,917 | B2 | 6/2016 | Takagi et al. |
| 2009/0206888 | A1 | 8/2009 | Kitazawa et al. |
| 2015/0062220 | A1 | 3/2015 | Kashimura et al. |
| 2017/0001435 | A1 | 1/2017 | Nozawa |

FOREIGN PATENT DOCUMENTS

| | | | |
|---|---|---|---|
| JP | 2009-010287 | A | 1/2009 |
| JP | 2009-190287 | A | 8/2009 |
| JP | 2010-114711 | A | 5/2010 |

*Primary Examiner* — Julian Huffman
(74) *Attorney, Agent, or Firm* — Harness, Dickey & Pierce, P.L.C.

(57) ABSTRACT

A liquid ejecting apparatus which includes a modulation circuit which generates a modulated signal obtained by performing pulse modulation with respect to a source signal as a source of a driving signal; a boosting circuit which outputs a voltage boosted by at least a first capacitor; a pair of transistors which generates an amplified-modulated signal based on the modulated signal; a low pass filter which generates a driving signal by smoothing the amplified-modulated signal; a voltage generating circuit which outputs an offset voltage from an output terminal; and a second capacitor which is electrically connected to the output terminal, in which at least the boosting circuit and the voltage generating circuit are integrated in an integrated circuit, and a distance between the first capacitor and the integrated circuit is shorter than a distance between the second capacitor and the integrated circuit.

5 Claims, 12 Drawing Sheets

<DECODING CONTENTS OF DECODER>

| PRINTING DATA Data | T1 | | T2 | |
|---|---|---|---|---|
| | Sa | Sb | Sa | Sb |
| (1, 1) | H | L | H | L |
| (0, 1) | H | L | L | H |
| (1, 0) | L | L | L | H |
| (0, 0) | L | H | L | L |

MSB LSB

LIQUID EJECTING APPARATUS AND HEAD UNIT

CROSS-REFERENCE TO RELATED APPLICATIONS

This is a continuation application of U.S. application Ser. No. 15/235,624, filed on Aug. 12, 2016, which claims priority to Japanese Patent Application No. 2015-167519, filed on Aug. 27, 2015. Both applications are expressly incorporated by reference herein in their entireties.

BACKGROUND

1. Technical Field

The present invention relates to a liquid ejecting apparatus and a head unit.

2. Related Art

As a liquid ejecting apparatus, typically, as a printing apparatus which prints an image or a document by causing ink to be ejected from nozzles, an apparatus in which a piezoelectric element is used has been known. The piezoelectric elements are provided corresponding to a plurality of nozzles in a head unit, respectively, cause ink (liquid) of a predetermined amount to be ejected from nozzles at a predetermined timing by being driven, respectively, according to a driving signal, thereby forming dots. Since the piezoelectric element is a capacitive load such as a capacitor in an electrical view, it is necessary to supply sufficient currents in order to operate the piezoelectric element in each nozzle.

For this reason, a liquid ejecting apparatus in the related art has a configuration in which a piezoelectric element is driven, by supplying a driving signal which is obtained by amplifying a source signal in an amplifying circuit to the head unit. For the amplifying circuit, there is a method in which a source signal before being amplified is subjected to current amplification using class AB amplification, or the like (linear amplification, refer to JP-A-2009-10287). However, since power consumption is large, and energy efficiency is not good in linear amplification, class D amplification has been also proposed in recent years (refer to JP-A-2010-114711).

Meanwhile, high speed printing or high resolution printing is highly desired in a printing apparatus, and in order to execute high speed printing, the number of dots which can be formed per unit hour may be increased. In addition, in order to execute high resolution printing, an amount of ink which is ejected from nozzles may be set to be small, and the number of dots which can be formed per unit area may be increased. That is, the number of dots which can be formed per unit hour and per unit area may be increased in order to execute high speed printing and high resolution printing, and for this reason, a method in which an ink ejecting frequency is increased is adopted.

In order to increase the ink ejecting frequency, it is necessary to increase a frequency of a driving signal which is supplied to a piezoelectric element. In order to cause ink to be stably ejected, by increasing a frequency of a driving signal, it is necessary to increase a switching frequency in class D amplification.

However, when increasing the switching frequency, a loss due to switching becomes large, and after all, energy efficiency in the class D amplification becomes lower than that in linear amplification, and it is not possible to obtain high energy efficiency which is an advantage of the class D amplification. Moreover, in a case in which switching in the class D amplification is set to a high frequency, there also is a problem of an erroneous operation due to noise.

When a switching frequency in the class D amplification is increased in order to increase a frequency of a driving signal which drives a piezoelectric element in this manner, it will cause many problems.

SUMMARY

An advantage of some aspects of the invention is to provide a technology in which it is possible to execute high speed printing and high resolution printing in a configuration in which a piezoelectric element is driven using a driving signal which is subjected to class D amplification.

According to an aspect of the invention, there is provided a liquid ejecting apparatus which includes a modulation circuit which generates a modulated signal obtained by performing pulse modulation with respect to a source signal as a source of a driving signal; a boosting circuit which outputs a voltage boosted by at least a first capacitor; a gate driver in which the voltage boosted by the boosting circuit is used as a power supply, and which generates a control signal based on the modulated signal; a pair of transistors which generates an amplified-modulated signal based on the control signal; a low pass filter which generates a driving signal by smoothing the amplified-modulated signal; a piezoelectric element which is displaced when being applied with the driving signal; a cavity of which an internal volume varies due to displacement of the piezoelectric element; a nozzle which is provided in order to cause liquid in the cavity to be ejected according to a change in internal volume of the cavity; a voltage generating circuit which applies an offset voltage to an electrode which is different from an electrode to which a driving signal of the piezoelectric element is applied, from an output terminal; and a second capacitor of which one end is electrically connected to the output terminal of the voltage generating circuit, in which at least the boosting circuit and the voltage generating circuit are integrated in an integrated circuit, and a distance between the first capacitor and the integrated circuit is shorter than a distance between the second capacitor and the integrated circuit.

In the liquid ejecting apparatus according to the aspect, since it is possible to perform appropriate disposing of components while securing a stable operation of class D amplification, a size of a circuit can be reduced while maintaining a waveform accuracy of a driving signal.

A source signal is a signal as a source of a driving signal which regulates a displacement of a piezoelectric element, that is, a signal before modulating, and a signal as a reference of a waveform of a driving signal (regardless of analog or digital, including signal for regulating). A modulated signal is a digital signal which is obtained by performing pulse modulation with respect to the source signal (for example, pulse width modulation, pulse density modulation, or the like).

A low pass filter is typically configured, using an inductor (coil) and a capacitor, and a resistor may be added thereto. The low pass filter may be configured, using a resistor and a capacitor without an inductor.

In the liquid ejecting apparatus, the integrated circuit may include a first terminal which is electrically connected to the first capacitor, and a second terminal which is electrically connected to the second capacitor, and a distance between the first capacitor and the first terminal may be shorter than a distance between the second capacitor and the second terminal.

The first terminal and the second terminal may be located so as to be close to each other.

In the liquid ejecting apparatus, the integrated circuit may be configured so that a region in which the boosting circuit is formed and a region in which the voltage generating circuit is formed are close to each other. The boosting circuit is apt to be a noise source, comparatively, since the circuit performs boosting, using the first capacitor; however, in contrast to this, a voltage generated in the voltage generating circuit is stable since the voltage is approximately a constant voltage. In the integrated circuit of the liquid ejecting apparatus, it is possible to suppress propagation of noise by performing a disposal in a form in which a region in which the boosting circuit is formed and a region in which the voltage generating circuit is formed are close to each other, and other regions are protected, in the inside of the integrated circuit.

In the liquid ejecting apparatus according to the aspect, a driving signal is generated by smoothing the amplified-modulated signal, the piezoelectric element is displaced by applying the driving signal, and liquid is caused to be ejected from a nozzle. Here, when the liquid ejecting apparatus analyzes a waveform of a driving signal for ejecting a small dot, for example, using a frequency spectrum, it is determined that a frequency component of 50 kHz or more is included. In order to generate a driving signal including such a frequency component of 50 kHz or more, it is necessary to set a frequency of a modulated signal (amplified-modulated signal) to 1 MHz or more.

If a frequency of a modulated signal is set to be lower than 1 MHz, an edge of a waveform of a driving signal which is reproduced becomes dull and round. In other words, a rough edge is smoothed down, and the waveform becomes dull. When the waveform of the driving signal becomes dull, a displacement of a piezoelectric element which is operated according to rising and falling edges of a waveform becomes moderate, tailing at a time of ejecting, an ejecting failure, or the like, occurs, and printing quality deteriorates.

Meanwhile, when a frequency of the modulated signal is set to be higher than 8 MHz, a resolving power of a waveform of the driving signal becomes high. However, a switching loss becomes large when a switching frequency in a transistor increases, and a power saving performance, and a performance of saving heat generation which are superior to linear amplification such as class AB amplification deteriorate.

In the liquid ejecting apparatus according to the aspect, it is preferable to set a frequency of the modulated signal to 1 MHz or more and 8 MHz or less.

The invention can be executed in various aspects, and can be executed in various aspects of a control method of the liquid ejecting apparatus, a single body of a head unit, or the like, for example.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment for executing the invention will be described with reference to drawings.

A printing apparatus according to the embodiment is a liquid ejecting apparatus which forms an ink dot group on a medium such as paper, by causing ink to be ejected according to image data which is supplied from an external host computer, and prints an image (including characters, figures, or the like) corresponding to the image data in this manner.

Figure 1:
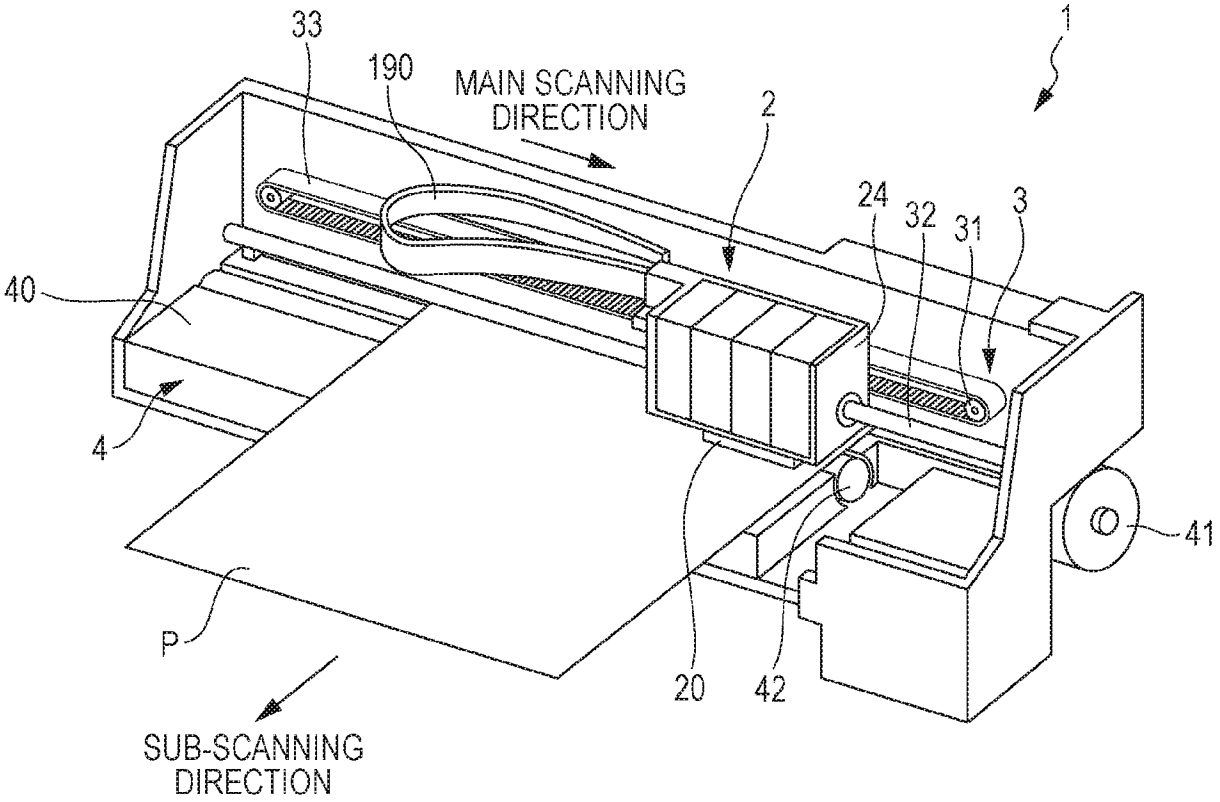
FIG. 1 is a diagram which illustrates a schematic configuration of a printing apparatus.

FIG. 1 is a perspective view which illustrates a schematic configuration of the inside of the printing apparatus.

As illustrated in the figure, a printing apparatus is provided with a movement mechanism 3 which causes a moving object 2 to move (reciprocating) in a main scanning direction.

The movement mechanism 3 includes a carriage motor 31 as a driving source of the moving object 2, a carriage guiding shaft 32 of which both ends are fixed, and a timing belt 33 which extends approximately in parallel to the carriage guiding shaft 32, and is driven by the carriage motor 31.

A carriage 24 of the moving object 2 is supported by the carriage guiding shaft 32 so as to reciprocate, and is fixed to a part of the timing belt 33. For this reason, when the timing belt 33 is subjected to forward-reverse driving by the carriage motor 31, the moving object 2 is guided by the carriage guiding shaft 32, and reciprocates.

A head unit 20 is provided at a portion of the moving object 2 which faces a medium P. As described later, the head unit 20 causes ink droplets (liquid droplets) to be ejected from a plurality of nozzles, and has a configuration in which various control signals are supplied through a flexible cable 190.

The printing apparatus 1 is provided with a transport mechanism 4 which transports the medium P on a platen 40 in a sub-scanning direction. The transport mechanism 4 is provided with a transport motor 41 as a driving source, and a transport roller 42 which is rotated by the transport motor 41, and transports the medium P in the sub-scanning direction.

An image is formed on the surface of the medium P when the head unit 20 ejects ink droplets on the medium P at a timing in which the medium P is transported by the transport mechanism 4.

Figure 2:
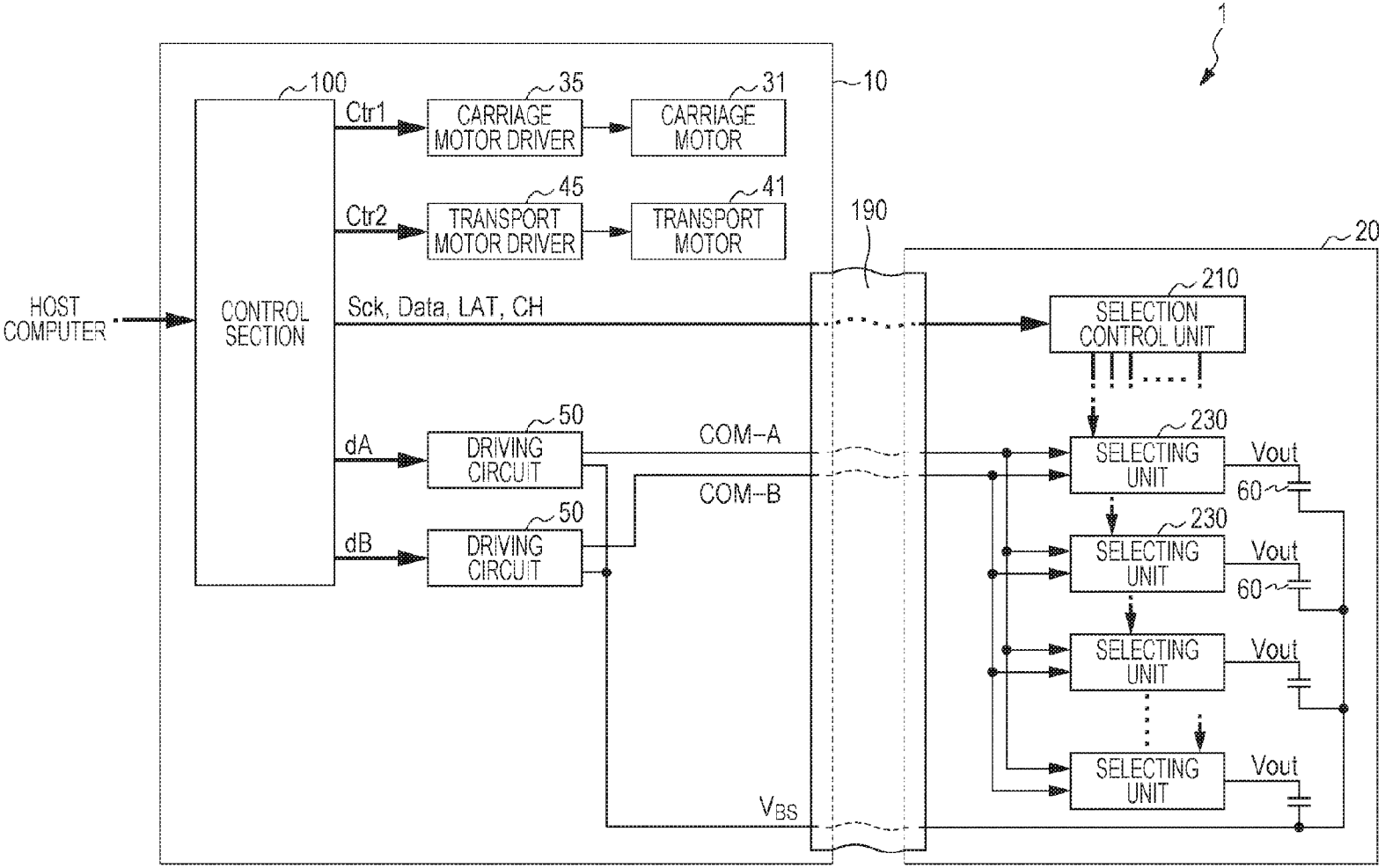
FIG. 2 is a block diagram which illustrates a configuration of the printing apparatus.

FIG. 2 is a block diagram which illustrates an electrical configuration of the printing apparatus.

As illustrated in the figure, in the printing apparatus 1, a control unit 10 and the head unit 20 are connected through the flexible cable 190.

The control unit 10 includes a control section 100, the carriage motor 31, a carriage motor driver 35, the transport motor 41, a transport motor driver 45, and two driving circuits 50. Among these, the control section 100 is a type of a microcomputer which includes a CPU, a storage unit, or the like, and outputs various control signals, and the like, which control each unit by executing a predetermined program, when image data which regulates an image to be formed on the medium P is supplied from the host computer, or the like.

Specifically, first, the control section 100 supplies a control signal Ctr1 to the carriage motor driver 35, and the carriage motor driver 35 drives the carriage motor 31 according to the control signal Ctr1. In this manner, a movement in the main scanning direction with respect to the carriage 24 is controlled.

Secondly, the control section 100 supplies a control signal Ctr2 to the transport motor driver 45, and the transport motor driver 45 drives the transport motor 41 according to the control signal Ctr2. In this manner, a movement in the sub-scanning direction using the transport mechanism 4 is controlled.

Thirdly, the control section 100 supplies digital data dA which regulates a waveform of a driving signal COM-A to one of the two driving circuits 50, and supplies digital data dB which regulates a driving signal COM-B to the other, in synchronization with driving of the carriage motor 31 through the control signal Ctr1. The data items dA and dB are stored in the storage unit in advance, for example, are read at intervals synchronized with driving of the carriage motor 31 using the control section 100, and are supplied to the respective driving circuits 50.

The one driving circuit 50 performs class D amplification with respect to data dA after performing an analog conversion, supplies a signal which is amplified to the head unit 20 as the driving signal COM-A, and generates a voltage $V_{BS}$. The other driving circuit 50 performs class D amplification with respect to data dB after performing an analog conversion, supplies a signal which is amplified to the head unit 20 as the driving signal COM-B, and generates a voltage $V_{BS}$.

In this example, a configuration in which the voltages $V_{BS}$ which are generated by the two driving circuits 50 are set to be common, and are supplied to the head unit 20 is adopted; however, it may be a configuration in which only a voltage $V_{BS}$ which is generated by any one of the driving circuits 50 is supplied to the head unit 20.

A detail of the driving circuit 50 will be further described later.

Fourthly, the control section 100 supplies a clock signal Sck, a data signal Data, control signals LAT and CH to the head unit 20.

Meanwhile, the head unit 20 includes a selection control unit 210, and a plurality of sets of selecting units 230 and piezoelectric elements 60.

The selection control unit 210 instructs the respective selecting units 230 whether to select the driving signal COM-A or the driving signal COM-B (or to select neither of signals) using a control signal, or the like, which is supplied from the control section 100, and the selecting unit 230 selects the driving signal COM-A or the driving signal COM-B according to an instruction of the selection control unit 210, and supplies the signal to one end of the piezoelectric elements 60 as a driving signal, respectively. In the figure, a voltage of the driving signal is denoted by Vout.

The other end of the respective piezoelectric elements 60 is commonly applied with a voltage $V_{BS}$ which is generated in the driving circuit 50 through the flexible cable 190.

The piezoelectric element 60 is provided corresponding to a respective plurality of nozzles in the head unit 20. In addition, the piezoelectric element 60 causes ink to be ejected by being displaced according to a difference between the voltage Vout and the voltage $V_{BS}$ of a driving signal which is selected by the selecting unit 230. Therefore, subsequently, a configuration in which ink is ejected due to driving with respect to the piezoelectric element 60 will be simply described.

Figure 3:
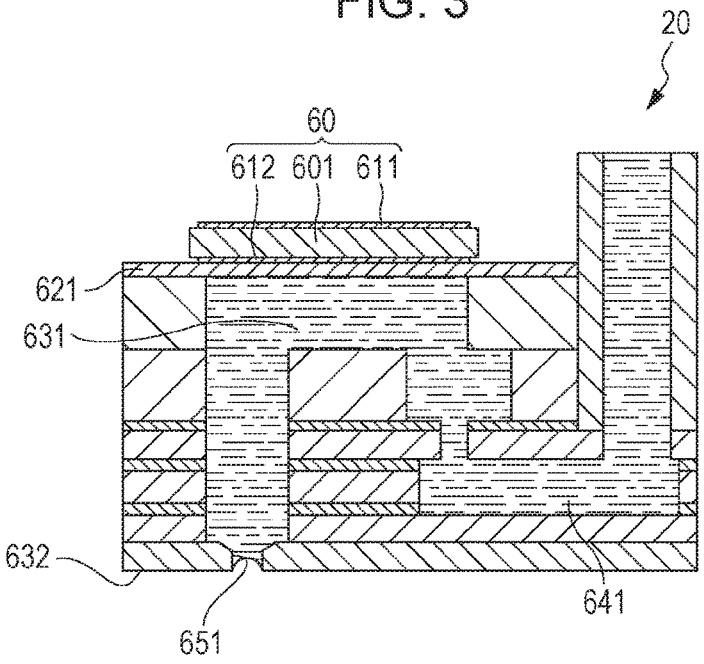
FIG. 3 is a diagram which illustrates a configuration of an ejecting unit in a head unit.

FIG. 3 is a diagram which illustrates a schematic configuration corresponding to one nozzle in the head unit 20.

As illustrated in the figure, the head unit 20 includes the piezoelectric element 60, a vibrating plate 621, a cavity (pressure chamber) 631, a reservoir 641, and a nozzle 651. Among these, the vibrating plate 621 is displaced (bending vibration) due to the piezoelectric element 60 which is provided on a top face in the figure, and functions as a diaphragm which enlarges or contracts an internal volume of the cavity 631 which is filled with ink. The nozzle 651 is an opening hole portion which is provided in a nozzle plate 632, and communicates with the cavity 631.

The piezoelectric element 60 illustrated in the figure has a structure in which a piezoelectric substance 601 is interposed between a pair of electrodes 611 and 612. In the piezoelectric substance 601 with the structure, a center portion in the figure bends in the vertical direction with respect to both end portions along with the electrodes 611 and 612, and the vibrating plate 621 according to a voltage applied by the electrodes 611 and 612. Specifically, the piezoelectric element 60 bends upward when a voltage Vout of a driving signal increases, and on the other hand, the piezoelectric element bends downward when the voltage Vout decreases. In this configuration, when the piezoelectric element bends upward, ink is drawn into the cavity from the reservoir 641, since the internal volume of the cavity 631 enlarges, and on the other hand, when the piezoelectric element bends downward, since the internal volume of the cavity 631 contracts, ink is ejected from the nozzle 651 depending on a degree of the contraction. For this reason, an ejecting unit which ejects ink is configured by the piezoelectric element 60, the cavity 631, and the nozzle 651.

The piezoelectric element 60 may be a type which can cause liquid such as ink to be ejected by deforming the piezoelectric element 60, without being limited to the illustrated structure. In addition, the piezoelectric element 60 may have a configuration in which a vertical vibration is used without being limited to bending vibration.

The piezoelectric element 60 is provided corresponding to the cavity 631 and the nozzle 651 in the head unit 20, and the piezoelectric element 60 is provided also corresponding to the selecting unit 230 in FIG. 2. For this reason, a set of the piezoelectric element 60, the cavity 631, and the selecting unit 230 is provided in each nozzle 651 (ejecting unit).

Figure 4A:
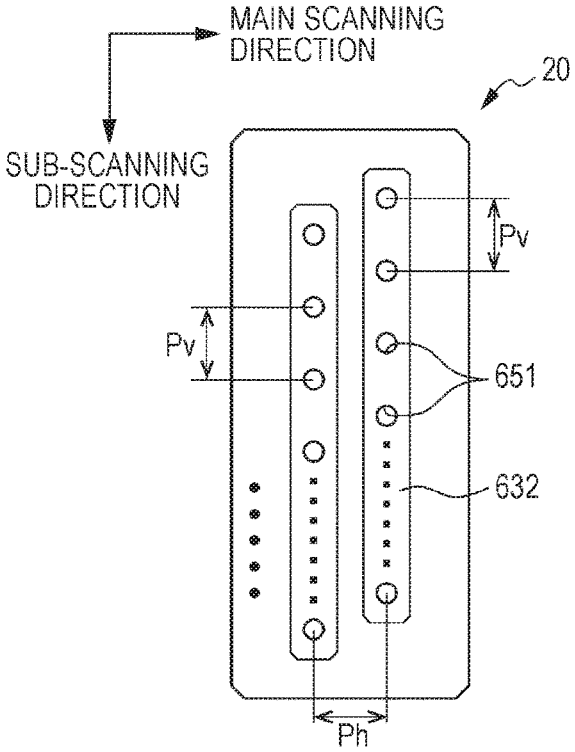
FIG. 4A is a diagram which illustrates a nozzle arrangement in the head unit.

FIG. 4A is a diagram which illustrates an example of arrangement of the nozzles 651.

As illustrated in the figure, the nozzles 651 are arranged in two columns as described below, for example. Specifically, when viewing one column, a plurality of the nozzles 651 are arranged at a pitch Pv along the sub-scanning direction, and meanwhile, when viewing two columns, the nozzles are separated by a pitch Ph in the main scanning direction, and are in a relationship of being shifted by a half of the pitch Pv in the sub-scanning direction.

In a case of color printing, in the nozzle 651, patterns corresponding to each of colors of C (cyan), M (magenta), Y (yellow), K (black), and the like, are provided along the main scanning direction, for example; however, in the following descriptions, for simplification, a case in which gradation is expressed, using a single color will be described.

Figure 4B:
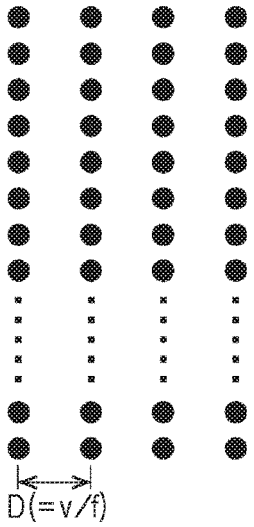
FIG. 4B is a diagram which describes dots which are formed by the ejecting unit.

FIG. 4B is a diagram which describes basic resolution of an image formation using a nozzle arrangement which is illustrated in FIG. 4A. The figure is an example of a method of forming one dot (first method) by causing ink droplets to be ejected once from the nozzle 651, in order to simplify descriptions, and black circles denote dots which are formed due to landing of ink droplets.

When the head unit 20 moves in the main scanning direction at a speed of v, as illustrated in the figure, an interval D (in main scanning direction) of dots which are formed due to landing of ink droplets, and the speed v are in the following relationship.

That is, in a case in which one dot is formed due to ejecting of ink of one time, the interval D of dots is denoted by a value (=v/f) which is obtained by dividing the speed v by an ink ejecting frequency f, in other words, a movement distance of the head unit 20 in a cycle (1/f) in which ink droplets are repeatedly ejected.

In the example in FIG. 4B, ink droplets which are ejected from the nozzles 651 of two columns are landed on the medium P so as to be aligned on the same column, in a relationship in which the pitch Ph is proportional to the interval D using a coefficient n. For this reason, as illustrated in FIG. 4B, a dot interval in the sub-scanning direction becomes a half of the dot interval in the main scanning direction. It is needless to say that the dot arrangement is not limited to the illustrated example.

Incidentally, in order to execute high speed printing, the movement speed v of the head unit 20 in the main scanning direction may be increased, in a simple way. However, the interval D of dots becomes long merely by increasing the speed v. For this reason, in order to execute high speed printing after securing resolution to some extent, it is necessary to increase the number of dots which is formed per unit hour by increasing the ink ejecting frequency f.

In order to increase resolution, separately from printing speed, the number of dots which is formed per unit hour may be increased. However, when ink is not set to a small amount in a case of increasing the number of dots, not only adjacent dots are combined, but also printing speed decreases, when the ink ejecting frequency f is not increased.

In this manner, in order to execute high speed printing and high resolution printing, it is necessary to increase the ink ejecting frequency f, as described above.

Meanwhile, as a method of forming dots on the medium P, there is a method of forming one dot (second method) by combining one or more ink droplets which are landed, by causing the one or more ink droplets which are ejected in a unit period to land, or a method of forming two or more dots (third method) without combining the two or more ink droplets, by setting ink droplets to be ejected two times or more in a unit period, in addition to a method of forming one dot by causing ink droplets to be ejected once. In the following descriptions, a case in which dots are formed by using the second method will be described.

In the embodiment, the second method will be described by assuming the following example. That is, in the embodiment, one dot is expressed in four gradations of a large dot, a medium dot, a small dot, and non-recording by causing ink to be ejected two times at maximum. In order to express the four gradations, according to the embodiment, two types of driving signals of COM-A and COM-B are prepared, and the first half pattern and the second half pattern are provided in one cycle in each of the driving signals. A configuration in which the driving signal COM-A or COM-B is selected (or not selected) according to a gradation to be expressed, in the first half and the second half in one cycle, and is supplied to the piezoelectric element 60 is adopted.

Therefore, the driving signals COM-A and COM-B will be described, and a configuration for selecting the driving signal COM-A or COM-B will be described thereafter. The driving signals COM-A and COM-B are generated by the driving circuit 50, respectively, and for convenience, the driving circuit 50 will be described after describing the configuration for selecting the driving signal COM-A or COM-B.

Figure 5:
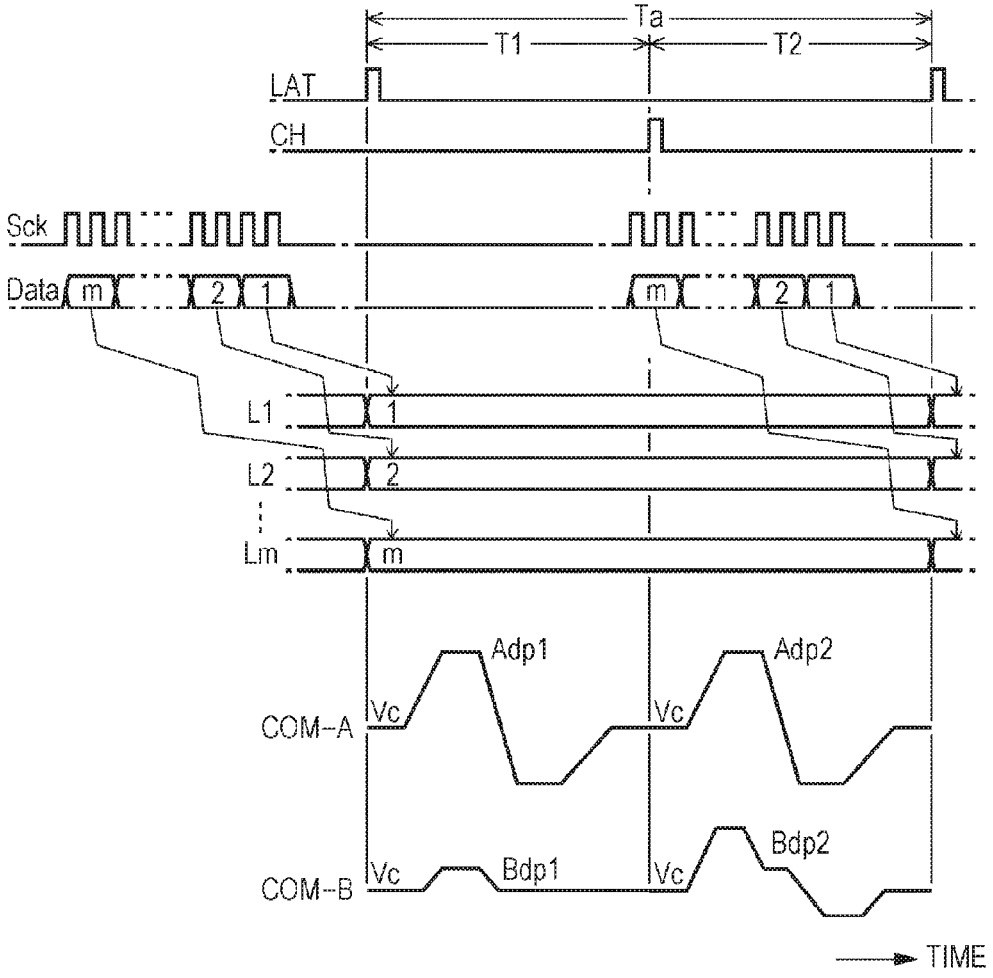
FIG. 5 is a diagram which describes an operation of a selection control unit in the head unit.

FIG. 5 is a diagram which illustrates waveforms of the driving signals COM-A and COM-B, or the like.

As illustrated in the figure, the driving signal COM-A is formed in a waveform in which a trapezoidal waveform Adp1 which is disposed in a period T1 from outputting (rising) of the control signal LAT to outputting of the control signal CH, in a printing period Ta, and a trapezoidal waveform Adp2 which is disposed in a period T2 from outputting of the control signal CH to outputting of the subsequent control signal LAT, in the printing period Ta are continuously repeated.

In the embodiment, the trapezoidal waveforms Adp1 and Adp2 are approximately the same waveform as each other, and when it is assumed that the respective waveforms are supplied to one end of the piezoelectric element 60, the trapezoidal waveforms are waveforms which causes ink of a predetermined amount, specifically, ink of a moderate amount to be ejected from nozzles 651 corresponding to the piezoelectric element 60, respectively.

The driving signal COM-B is formed in a waveform in which a trapezoidal waveform Bdp1 which is disposed in the period T1 and a trapezoidal waveform Bdp2 which is disposed in the period T2 are continuously repeated. In the embodiment, the trapezoidal waveforms Bdp1 and Bdp2 are different from each other. In these, the trapezoidal waveform Bdp1 is a waveform which prevents an increase in viscosity of ink by causing ink in the vicinity of the opening hole portion of the nozzle 651 to minutely vibrate. For this reason, even when the trapezoidal waveform Bdp1 is supplied to one end of the piezoelectric element 60, ink droplets are not ejected from the nozzle 651 corresponding to the piezoelectric element 60. The trapezoidal waveform Bdp2 is a waveform which is different from the trapezoidal waveform Adp1 (Adp2). The trapezoidal waveform is a waveform which causes ink of an amount smaller than the above described predetermined amount to be ejected from a nozzle 651 corresponding to the piezoelectric element 60, when it is assumed that the trapezoidal waveform Bdp2 is supplied to one end of the piezoelectric element 60.

Both a voltage at a start timing and a voltage at an ending timing of the trapezoidal waveforms Adp1, Adp2, Bdp1, and Bdp2 are a voltage Vc, and common. That is, the trapezoidal waveforms Adp1, Adp2, Bdp1, and Bdp2 are waveforms which start in the voltage Vc, and end in the voltage Vc, respectively.

Figures 6, 7:
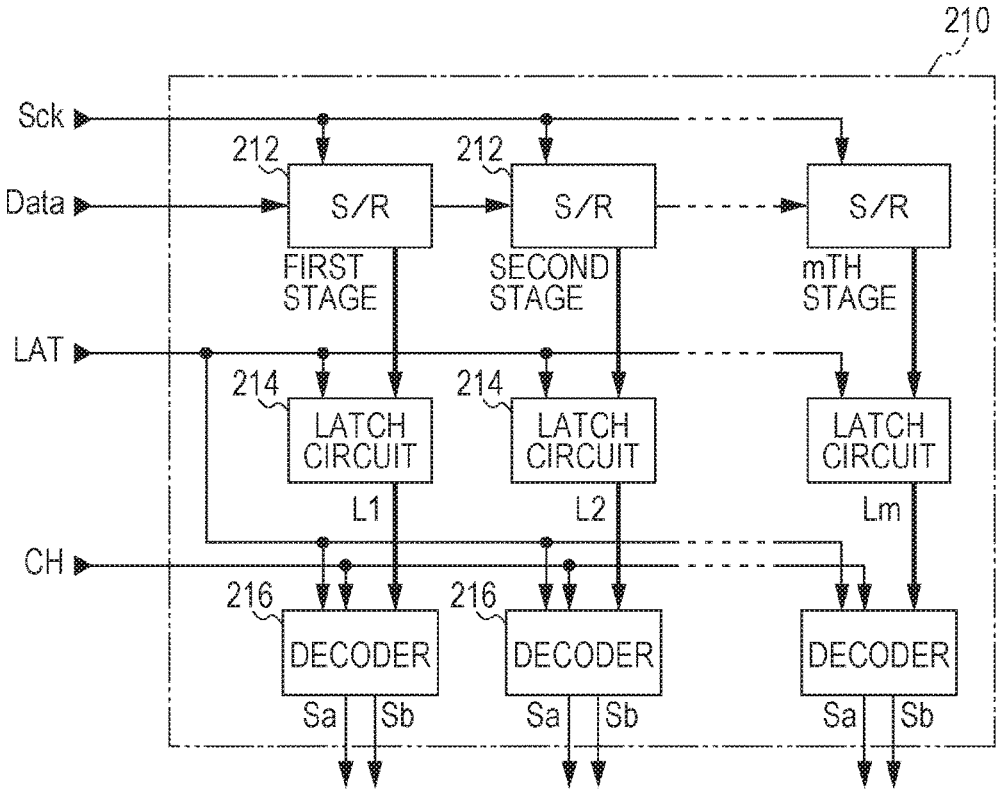
FIG. 6 is a diagram which illustrates a configuration of the selection control unit in the head unit.
FIG. 7 is a diagram which illustrates decoding contents of a decoder in the head unit.

FIG. 6 is a diagram which illustrates a configuration of the selection control unit 210 in FIG. 2.

As illustrated in the figure, the clock signal Sck, the data signal Data, and the control signals LAT and CH are supplied to the selection control unit 210 from the control unit 10. A group of a shift register (S/R) 212, a latch circuit 214, and a decoder 216 is provided in the selection control unit 210, by corresponding to respective piezoelectric elements 60 (nozzle 651).

When forming one dot of an image, the data signal Data regulates a size of the dot. According to the embodiment, the data signal Data is configured of two bits of a high-order bit (MSB) and a low-order bit (LSB), in order to express four gradations of non-recording, a small dot, a medium dot, and a large dot.

The data signal Data is supplied to each nozzle from the control section 100 in series, in accordance with main scanning of the head unit 20, in synchronization with the clock signal Sck. The shift register 212 is configured so as to temporarily hold two bits of the data signal Data corresponding to nozzles, which is supplied in series.

In detail, it is a configuration in which the shift registers 212 with the number of stages corresponding to the piezoelectric element 60 (nozzle) are vertically connected to each other, and the data signal Data which is supplied in series is sequentially transmitted to the rear stage according to the clock signal Sck.

When the number of piezoelectric elements 60 is set to m (m is plural number), in order to distinguish the shift register 212, the shift register is denoted by the first stage, the second stage, . . . , the mth stage in order, from the upstream side on which the data signal Data is supplied.

The latch circuit 214 latches the data signal Data which is held in the shift register 212 using rising of the control signal LAT.

The decoder 216 decodes the data signal Data of two bits which is latched by the latch circuit 214, outputs selection signals Sa and Sb in each period of T1 and T2 which is regulated by the control signal LAT and the control signal CH, and regulates a selection in the selecting unit 230.

FIG. 7 is a diagram which illustrates decoding contents in the decoder 216.

In the figure, the latched printing data Data of two bits are denoted by MSB and LSB. When the latched printing data Data is (0, 1), for example, it means that the decoder 216 sets logic levels of the selection signals Sa and Sb to an H level and an L level, respectively, in the period T1, and to the L level and the H level, respectively, in the period T2, and outputs thereof.

The logic level of the selection signals Sa and Sb is level-shifted to high-amplitude logic using a level shifter (not illustrated), compared to logic levels of the clock signal Sck, the printing data Data, and the control signals LAT and CH.

Figure 8:
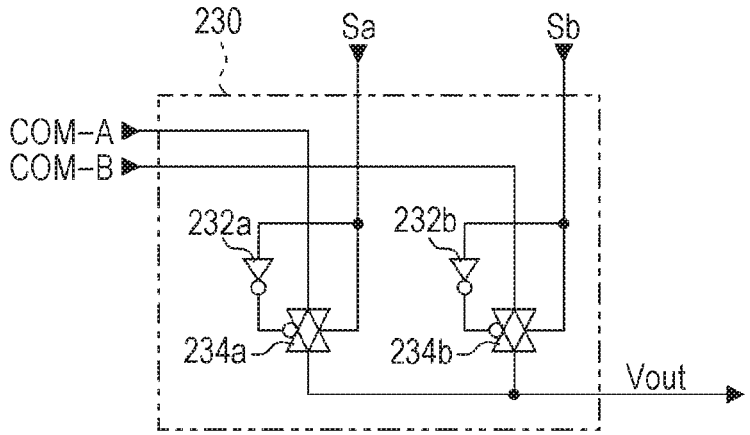
FIG. 8 is a diagram which illustrates a configuration of a selecting unit in the head unit.

FIG. 8 is a diagram which illustrates a configuration of the selecting unit 230 corresponding to one piezoelectric element 60 (nozzle 651) in FIG. 2.

As illustrated in the figure, the selecting unit 230 includes inverters (NOT circuit) 232*a* and 232*b*, and transfer gates 234*a* and 234*b*.

The selection signal Sa from the decoder 216 is supplied to a positive control end of the transfer gate 234*a* to which a circle is not attached, and meanwhile, is supplied to a negative control end of the transfer gate 234*a* to which a circle is attached by being subjected to a logical inversion using the inverter 232*a*. Similarly, the selection signal Sb is supplied to a positive control end of the transfer gate 234*b*, and meanwhile, is supplied to a negative control end of the transfer gate 234*b* by being subjected to a logical inversion using the inverter 232*b*.

The driving signal COM-A is supplied to an input end of the transfer gate 234*a*, and the driving signal COM-B is supplied to an input end of the transfer gate 234*b*. Output ends of the transfer gates 234*a* and 234*b* are commonly connected, and are connected to one end of a corresponding piezoelectric element 60.

The transfer gate 234*a* causes the input end and the output end to be electrically connected (ON) therebetween, when the selection signal Sa is an H level, and causes the input end and the output end not to be electrically connected (OFF) therebetween, when the selection signal Sa is an L level. Similarly, the transfer gate 234*b* also sets the input end and the output end to ON/OFF therebetween, according to the selection signal Sb.

Subsequently, operations of the selection control unit 210 and the selecting unit 230 will be described with reference to FIG. 5.

The data signal Data is supplied in series to each nozzle from the control section 100, in synchronization with the clock signal Sck, and is sequentially transmitted in the shift registers 212 corresponding to the nozzle. In addition, when the control section 100 stops supplying of the clock signal Sck, it enters a state in which the data signal Data corresponding to the nozzle is held in the respective shift registers 212. The data signal Data is supplied in sequential order corresponding to the nozzle of the last stage m, . . . , the second stage, the first stage in the shift register 212.

Here, when the control signal LAT rises, the respective latch circuits 214 simultaneously latch the data signals Data stored in the shift register 212. In FIG. 5, L1, L2, . . . , Lm denote data signals Data which are obtained by latching the data signal Data using the latch circuit 214 corresponding to the shift registers 212 of the first stage, the second stage, . . . , the mth stage.

The decoder 216 outputs the selection signal Sa, and a logic level of the signal Sa using contents which are illustrated in FIG. 7, in respective periods T1 and T2, according to a size of a dot which is regulated by the latched data signal Data.

That is, first, in a case in which the data signal Data is (1, 1), and a size of a large dot is regulated, the decoder 216 sets the selection signals Sa and Sb to an H level and an L level in the period T1, and to the H level and the L level also in the period T2. Secondly, in a case in which the data signal Data is (0, 1), and a size of a medium dot is regulated, the decoder 216 sets the selection signals Sa and Sb to the H level and the L level in the period T1, and to the L level and the H level in the period T2. Thirdly, in a case in which the data signal Data is (1, 0), and a size of a small dot is regulated, the decoder 216 sets the selection signals Sa and Sb to the L level and the L level in the period T1, and to the L level and the H level in the period T2. Fourthly, in a case in which the data signal Data is (0, 0), and non-recording is regulated, the decoder 216 sets the selection signals Sa and Sb to the L level and the H level in the period T1, and to the L level and the L level in the period T2.

Figure 9:
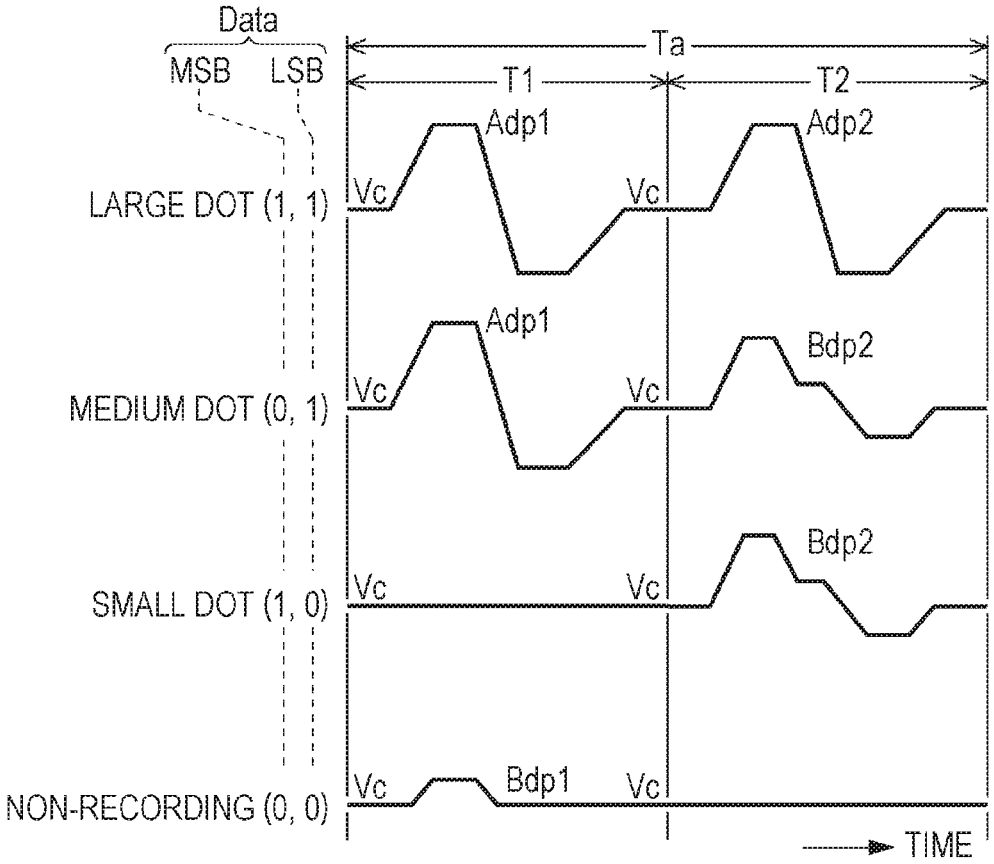
FIG. 9 is a diagram which illustrates a driving signal which is selected by the selecting unit.

FIG. 9 is a diagram which illustrates a voltage waveform of a driving signal which is selected according to the data signal Data, and is supplied to one end of the piezoelectric element 60.

Since the selection signals Sa and Sb become the H level and the L level in the period T1 when the data signal Data is (1, 1), the transfer gate 234*a* is turned on, and the transfer gate 234*b* is turned off. For this reason, the trapezoidal waveform Adp1 of the driving signal COM-A is selected in the period T1. Since the selection signals Sa and Sb become the H level and the L level also in the period T2, the selecting unit 230 selects the trapezoidal waveform Adp2 of the driving signal COM-A.

In this manner, when the trapezoidal waveform Adp1 is selected in the period T1, the trapezoidal waveform Adp2 is selected in the period T2, and the trapezoidal waveforms are supplied to one end of the piezoelectric element 60 as driving signals, ink of a moderate amount is ejected from a nozzle 651 corresponding to the piezoelectric element 60 in twice. For this reason, respective ink land on the medium P, are united, and as a result, a large dot as regulated by the data signal Data is formed.

Since the selection signals Sa and Sb become the H level and the L level in the period T1 when the data signal Data is (0, 1), the transfer gate 234*a* is turned on, and the transfer gate 234*b* is turned off. For this reason, the trapezoidal waveform Adp1 of the driving signal COM-A is selected in the period T1. Subsequently, since the selection signals Sa and Sb become the L level and the H level in the period T2, the trapezoidal waveform Bdp2 of the driving signal COM-B is selected.

Accordingly, ink of a moderate amount and a small amount are ejected in twice from a nozzle. For this reason, respective ink land on the medium P, are united, and as a result, a medium dot is formed, as regulated by the data signal Data.

Since both the selection signals Sa and Sb become the L level in the period T1 when the data signal Data is (1, 0), the transfer gates 234*a* and 234*b* are turned off. For this reason, neither the trapezoidal waveform Adp1 nor Bdp1 is selected in the period T1. In a case in which both the transfer gates 234*a* and 234*b* are turned off, a path from a connecting point of output ends of the transfer gates 234*a* and 234*b* to one end of the piezoelectric element 60 enters a high impedance state of not being electrically connected to any portion. However, the piezoelectric element 60 holds a voltage ($Vc-V_{BS}$) which is obtained immediately before the transfer gate is turned off, due to its own capacity.

Subsequently, since the selection signals Sa and Sb become the L level and the H level in the period T2, the trapezoidal waveform Bdp2 of the driving signal COM-B is selected. For this reason, since ink of a small amount is ejected only in the period T2 from the nozzle 651, a small dot is formed on the medium P as regulated by the data signal Data.

Since the selection signals Sa and Sb become the L level and the H level in the period T1 when the data signal Data is (0, 0), the transfer gate 234*a* is turned off, and the transfer gate 234*b* is turned on. For this reason, the trapezoidal waveform Bdp1 of the driving signal COM-B is selected in the period T1. Subsequently, since both the selection signals Sa and Sb become the L level in the period T2, neither the trapezoidal waveform Adp2 nor Bdp2 B is selected.

For this reason, since ink in the vicinity of the opening hole portion of the nozzle 651 minutely vibrates, and is not ejected in the period T1, as a result, a dot is not formed. That is, it becomes non-recording as regulated by the data signal Data.

In this manner, the selecting unit 230 selects (or does not select) the driving signal COM-A or COM-B according to an instruction of the selection control unit 210, and supplies the driving signal to one end of the piezoelectric element 60. For this reason, each piezoelectric element 60 is driven according to a size of a dot which is regulated by the data signal Data.

The driving signals COM-A and COM-B which are illustrated in FIG. 5 are merely examples. In practice, a combination of various waveforms which are prepared in advance is used according to a movement speed of the head unit 20, a property of the medium P, or the like.

Here, an example in which the piezoelectric element 60 bends upward along with an increase in voltage has been described; however, when a voltage supplied to the electrodes 611 and 612 is reversed, the piezoelectric element 60 bends downward along with an increase in voltage. For this reason, in a configuration in which the piezoelectric element 60 bends downward along with an increase in voltage, the driving signals COM-A and COM-B illustrated in the figure have waveforms which are reversed based on the voltage Vc.

In this manner, according to the embodiment, one dot is formed on the medium P in a unit of the cycle Ta which is a unit period. For this reason, in the embodiment in which one dot is formed, using ejecting of ink droplets of two times (at maximum) in the cycle Ta, the ink ejecting frequency f becomes 2/Ta, and the dot interval D becomes a value obtained by dividing the movement speed v of the head unit by the ink ejecting frequency f (=2/Ta).

In general, in a case in which it is possible to eject ink droplets Q (Q is integer of 2 or more) times in a unit period T, and one dot is formed, using ejecting of ink droplets of the Q times, it is possible to denote the ink ejecting frequency f by Q/T.

As in the embodiment, it is necessary to set a time for ejecting ink droplets once to be short, even when a time for forming one dot (cycle) is the same, in a case of forming dots of different sizes on the medium P, and a case of forming one dot using ejecting of ink droplets of one time.

Special descriptions for the third method in which two or more dots are formed without combining two or more ink droplets may not be necessary.

Subsequently, the driving circuit 50 will be described. When schematically describing the two driving circuits 50, the driving circuits output the driving signal COM-A (COM-B) as described below. That is, between the two driving circuits 50, one driving circuit firstly performs analog conversion with respect to the data dA which is supplied from the control section 100, secondly, feeds back the driving signal COM-A which is output, corrects a deviation between a signal based on the driving signal COM-A (attenuation signal) and a target signal using a high frequency component of the driving signal COM-A, and generates a modulated signal according to the corrected signal, thirdly, generates an amplified-modulated signal by switching a transistor according to the modulated signal, and fourthly, smoothes the amplified-modulated signal by using a low pass filter, and outputs the smoothed signal as the driving signal COM-A.

The other of the two driving circuits 50 has the same configuration, and is different only in a point that the driving signal COM-B is output from the data dB. Therefore, for convenience, the driving circuit 50 which outputs the driving signal COM-A will be described as an example.

Figure 10:
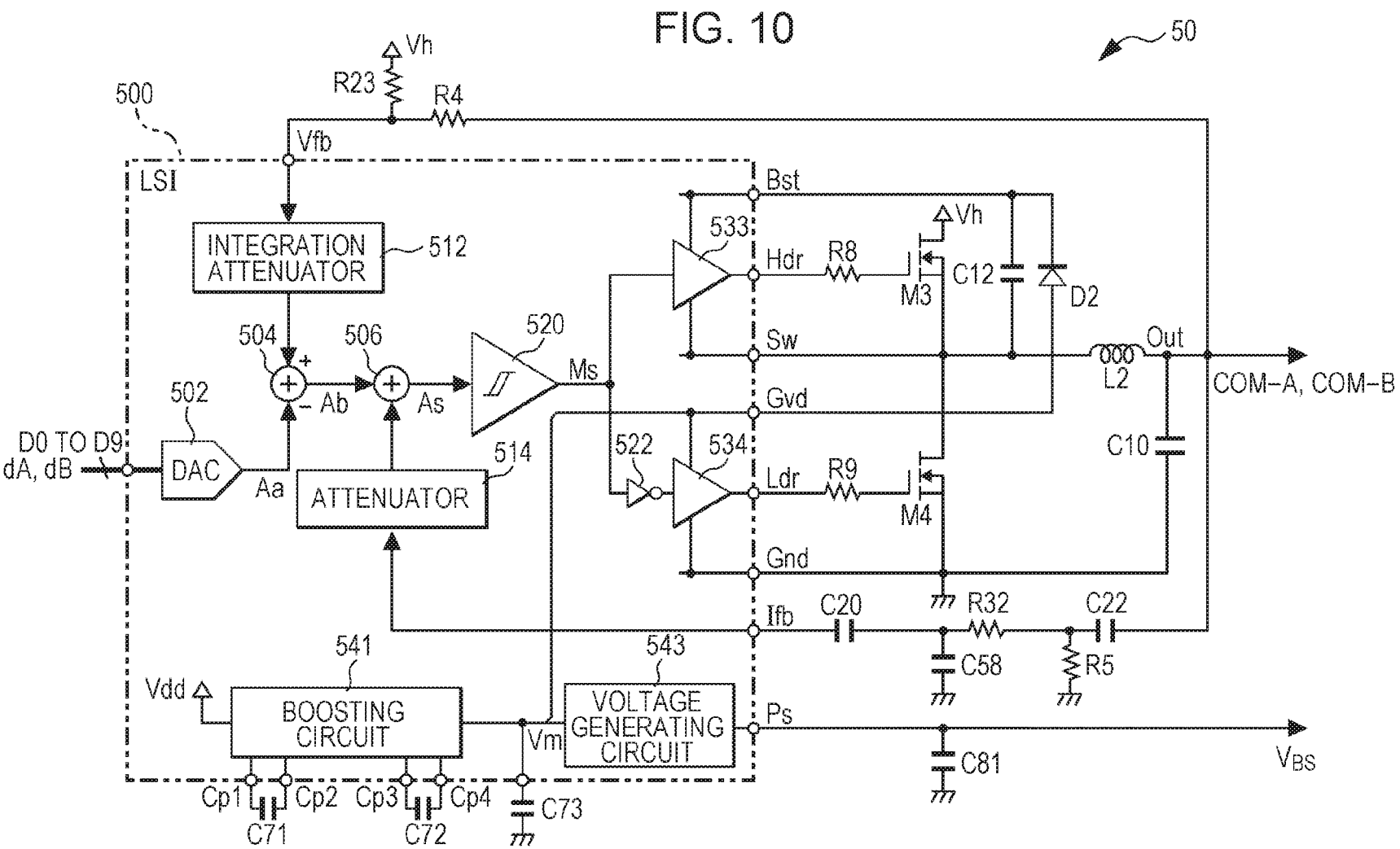
FIG. 10 is a diagram which illustrates a configuration of a driving circuit in the printing apparatus.

FIG. 10 is a diagram which illustrates a circuit configuration of the driving circuit 50.

As illustrated in the figure, the driving circuit 50 is configured of various elements such as a resistor, or a capacitor, in addition to an LSI 500, or transistors M3 and M4.

FIG. 10 illustrates a configuration of the driving circuit 50 which outputs the driving signal COM-A, and the driving circuit 50 which generates the driving signal COM-B also has the same configuration.

The large scale integration (LSI) 500 is an integrated circuit which configures main portions of the driving circuit 50, and outputs a gate signal to respective transistor M3 and M4 based on the data dA of 10 bits which is input from the control section 100 through pins DO to D9. In detail, the LSI 500 includes a digital-to-analog converter (DAC) 502, adders 504 and 506, an integration attenuator 512, an attenuator 514, a comparator 520, a NOT circuit 522, and gate drivers 533 and 534.

The DAC 502 converts the data dA which regulates a waveform of the driving signal COM-A into an analog signal Aa, and supplies the signal to an input end (−) of the adder 504. A voltage amplitude of the analog signal Aa is approximately 0 to 2 V, for example, and when amplifying the voltage approximately 20 times, it becomes the driving signal COM-A. That is, the analog signal Aa is a signal as a target before amplifying the driving signal COM-A.

The integration attenuator 512 attenuates a voltage of a terminal Out which is input through a pin Vfb, that is, the driving signal COM-A, integrates thereof, and supplies to an input end (+) of the adder 504.

The adder 504 supplies a signal Ab with a voltage which is obtained by subtracting a voltage in the input end (−) from a voltage in the input end (+), and integrating thereof to one side of an input end of the adder 506.

A power supply voltage of a circuit from the DAC 502 to the NOT circuit 522 (DAC 502, adder 504, integration attenuator 512, adder 506, attenuator 514, comparator 520, NOT circuit 522) is 3.3 V with low amplitude (voltage Vdd). For this reason, since there is a case in which a voltage of the driving signal COM-A is maximum, and exceeds 40 V, in contrast to the voltage of the analog signal Aa which is approximately 2 V at most, a voltage of the driving signal COM-A is attenuated by the integration attenuator 512 in order to cause amplitude ranges of both of the voltages to match, when obtaining a deviation.

The attenuator 514 attenuates a high frequency component of the driving signal COM-A which is input through a pin Ifb, and supplies thereof to the other side of the input end of the adder 506. The adder 506 supplies a signal As of a voltage which is obtained by adding a voltage on one side and a voltage on the other side of the input end to the comparator 520. Attenuating of the attenuator 514 is performed in order to cause amplitude to match, when feeding back the driving signal COM-A, similarly to the integration attenuator 512.

A voltage of the signal As which is output from the adder 506 is a voltage obtained by subtracting a voltage of the analog signal Aa from an attenuated voltage of a signal supplied to a pin Vfb, and adding an attenuated voltage of a signal supplied to the pin Ifb. For this reason, a voltage of the signal Ab using the adder 506 is a signal obtained by correcting a deviation obtained by subtracting a voltage of the analog signal Aa as a target from the attenuated voltage of the driving signal COM-A which is output from the terminal Out using the high frequency component of the driving signal COM-A.

The comparator 520 outputs a modulated signal Ms which is pulse-modulated as follows, based on a voltage added using the adder 506. In detail, the comparator 520 outputs a modulated signal Ms in which the signal As which is output from the adder 506 becomes an H level when being a voltage threshold value of Vth1 or more, in a case of a rising voltage, and becomes an L level when being less than the voltage threshold value of Vth2, in a case of a falling voltage. In addition, as described below, the voltage threshold value is set so as to satisfy a relationship of Vth1>Vth2.

The modulated signal Ms using the comparator 520 is supplied to the gate driver 534 through a logical inversion using the NOT circuit 522. Meanwhile, the modulated signal Ms is supplied to the gate driver 533 without being subjected to a logical inversion. For this reason, logic levels which are supplied to the gate drivers 533 and 534 are in an exclusive relationship with each other.

In practice, timings of the logic levels which are supplied to the gate drivers 533 and 534 may be controlled so as not to be the H level at the same time (so that transistors M3 and M4 are not turned on at the same time). For this reason, the exclusive relationship, referred to here, means that there is no case in which the logic levels become the H level at the same time (in case of transistors M3 and M4, transistors are not turned on at the same time), strictly speaking.

Incidentally, the modulated signal referred to here is the modulated signal Ms in a narrow sense; however, when considered as a signal which is subjected to pulse modulation according to the signal Aa, the modulated signal is included in a negative signal (NOT circuit 522 is also included in modulated signal) of the modulated signal Ms. That is, a signal obtained by reversing a logic level of the modulated signal Ms, or a signal which is subjected to a timing control is also included in the modulated signal which is pulse-modulated according to the signal Aa, not only the modulated signal Ms.

Since the comparator 520 outputs the modulated signal Ms, a circuit to the comparator 520, that is, the DAC 502, the adders 504 and 506, the integration attenuator 512, the attenuator 514, and the comparator 520 can be a modulation circuit which generates the modulated signal Ms.

In the configuration illustrated in FIG. 10, the digital data dA is converted into the analog signal Aa using the DAC 502; however, the signal Aa may be supplied from an external circuit according to an instruction of the control section 100, for example, not through the DAC 502. Since a target value when generating a waveform of the driving signal COM-A is regulated in both of the digital data dA and the analog signal Aa, both are surely source signals.

Both the gate drivers 533 and 534 output low-amplitude logic (L level: 0 V, H level: 3.3 V) which is input, as high-amplitude logic (for example, L level: 0 V, H level: 7.5 V), by performing a level shift with respect to the high-amplitude logic.

For example, the gate driver 533 inputs low-amplitude logic as an output signal of the comparator 520, performs a level shift with respect to the low-amplitude logic so as to be the high-amplitude logic, and outputs thereof from a pin Hdr, and the gate driver 534 inputs low-amplitude logic as an output signal of the NOT circuit 522, performs a level shift with respect to the low-amplitude logic so as to be the high-amplitude logic, and outputs thereof from a pin Ldr.

In the power supply voltages of the gate driver 533, a voltage on the high side is a voltage applied through a pin Bst, and a voltage on the low side is a voltage applied through a pin Sw. The pin Sw is connected to a source electrode in the transistor M3, a drain electrode in the transistor M4, the other end of the capacitor C12, and one end of the inductor L2.

In the power supply voltages of the gate driver 534, a voltage on the high side is a voltage Vm of approximately 10 V which is applied through a pin Gvd, and a voltage on the low side is a voltage of zero which is grounded through a pin Gnd. The pin Gvd is connected to a cathode electrode of a diode D2 for preventing backflow, and an anode electrode of the diode D2 is connected to one end of the capacitor C12, and a pin Bst.

The boosting circuit 541 boosts a voltage Vdd of 3.3 V, and generate the voltage Vm of approximately 10 V. The voltage Vm generated by the boosting circuit 541 is input to a voltage generating circuit 543, is used as a voltage on the high side of the gate driver 534, and is output to the outside of the LSI 500 through the pin Gvd. In the boosting, for example, two capacitors of a capacitor C71 through pins Cp1 and Cp2, and a capacitor C72 through pins Cp3 and Cp4 as external components of the LSI 500 are used. The voltage Vm which is generated by the boosting circuit 541 is applied to one end of a capacitor C73 as an external component. Meanwhile, the other end of the capacitor C73 is grounded. In this manner, the voltage Vm is stabilized.

The boosting circuit 541 will be described in detail later.

The voltage generating circuit 543 generates a voltage $V_{BS}$ of approximately 5.0 V to 6.5 V from the voltage Vm. The voltage $V_{BS}$ generated in the voltage generating circuit 543 is commonly applied to the other ends of the plurality of piezoelectric elements 60, and is applied to one end of a capacitor C81 as an external component. Since the other end of the capacitor C81 is grounded, in this manner, the voltage $V_{BS}$ is stabilized.

The voltage generating circuit 543 will be described in detail later. The reason why the capacitors C71, C72, C73, and C81 are set to the external components is that it is difficult to be integrated in the LSI 500.

The transistors M3 and M4 are, for example, N-channel field effect transistors (FET). In these, in the transistor M3 on the high side, a voltage Vh (for example, 42 V) is applied to a drain electrode, and a gate electrode is connected to a pin Hdr through a resistor R8. In the transistor M4 on the low side, a gate electrode is connected to a pin Ldr through a resistor R9, and a source electrode is grounded.

The other end of the inductor L2 is the terminal Out as an output of the driving circuit 50, and the driving signal COM-A is supplied to the head unit 20 from the terminal Out through the flexible cable 190 (refer to FIGS. 1 and 2).

The terminal Out is connected to one end of a capacitor C10, one end of a capacitor C22, and one end of a resistor R4, respectively. Among these, the other end of the capacitor C10 is grounded. For this reason, the inductor L2 and the capacitor C10 function as a low pass filter (LPF) which smoothes an amplified-modulated signal which appears at a connecting point of the transistors M3 and M4.

The other end of the resistor R4 is connected to the pin Vfb, and one end of the resistor R23, and the voltage Vh is applied to the other end of the resistor R23. In this manner, the driving signal COM-A from the terminal Out is pulled up, and is fed back to the pin Vfb.

Meanwhile, the other end of the capacitor C22 is connected to one end of the resistor R5, and one end of the resistor R32. In these, the other end of the resistor R5 is grounded. For this reason, the capacitor C22 and the resistor R5 function as a high pass filter (HPF) which causes a high frequency component of a cutoff frequency or more in the driving signal COM-A from the terminal Out to pass through. The cutoff frequency of HPF is set to approximately 9 MHz, for example.

The other end of the resistor R32 is connected to one end of the capacitor C20 and one end of a capacitor C58. In these, the other end of the capacitor C58 is grounded. For this reason, the resistor R32 and the capacitor C58 function as a low pass filter (LPF) which causes a low frequency component of a cutoff frequency or less in signal components which pass through the HPF to pass through. The cutoff frequency of LPF is set to approximately 160 MHz, for example.

Since the above described cutoff frequency of HPF is set to be lower than the above described cutoff frequency of LPF, the HPF and LPF function as a band pass filter (BPF) which causes a high frequency component in a predetermined frequency range, in the driving signal COM-A to pass through.

The other end of the capacitor C20 is connected to the pin Ifb of the LSI 500. In this manner, a DC component in the high frequency component of the driving signal COM-A which passes through the BPF is cut, and is fed back to the pin Ifb.

Incidentally, the driving signal COM-A which is output from the terminal Out is a signal which is obtained by palanarizing an amplified-modulated signal in the connecting point (pin Sw) of the transistors M3 and M4 using a low pass filter which is formed of the inductor L2 and the capacitor C10. Since the driving signal COM-A is positively fed back to the adder 504 after being integrated and subtracted through the pin Vfb, the driving signal is subjected to self-excited oscillation using a frequency which is determined by a delay in feedback (sum of delay due to smoothness of inductor L2 and capacitor C10, and delay using integration attenuator 512), and a transfer function of feedback.

However, since a delay amount of a feedback path through the pin Vfb is large, it is not possible to increase the frequency for self-excited oscillation so as to sufficiently secure an accuracy of the driving signal COM-A, only by the feedback through the pin Vfb.

Therefore, according to the embodiment, a delay in the entire circuit is set to be small, by providing a path to which a high frequency component of the driving signal COM-A is fed back through the pin Ifb, separately from a path through the pin Vfb. For this reason, it is possible to increase a frequency of the signal As which is obtained by adding the high frequency component of the driving signal COM-A to the signal Ab, so that it is possible to sufficiently secure an accuracy of the driving signal COM-A, compared to a case in which there is no path through the pin Ifb.

Figure 11:
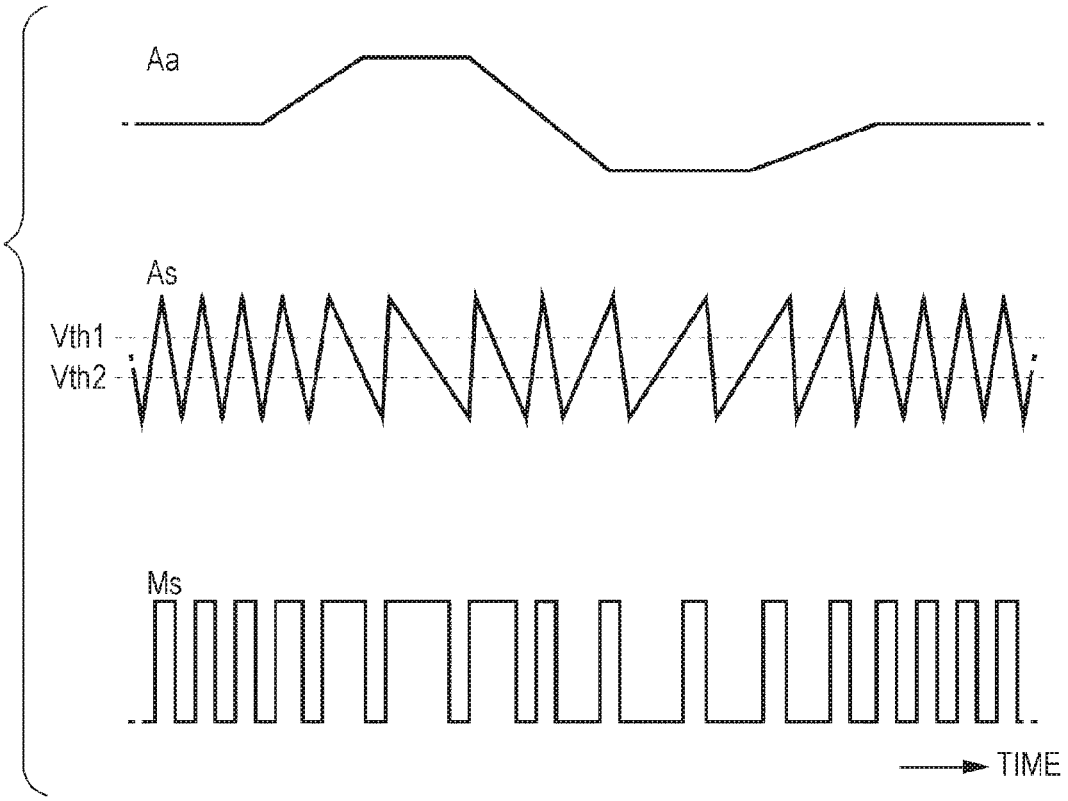
FIG. 11 is a diagram which describes operations of the driving circuit.

FIG. 11 is a diagram in which waveforms of the signal As and the modulated signal Ms are illustrated by being associated with a waveform of the analog signal Aa.

As illustrated in the figure, the signal As is a triangular wave, and an oscillating frequency thereof is changed according to a voltage (input voltage) of the analog signal Aa. Specifically, the oscillating frequency becomes the highest value in a case in which the input voltage is a medium value, and becomes low when the input value becomes higher, or lower than the medium value.

An inclination of the triangular wave in the signal As is appropriately the same in rising (rising of voltage) and falling (falling of voltage), when the input voltage is close to the medium value. For this reason, a duty ratio of the modulated signal Ms which is a result obtained by comparing the signal As with the voltage threshold values Vth1 and Vth2, using the comparator 520 becomes approximately 50%. When the input voltage becomes higher than the medium value, a falling inclination of the signal As become moderate. For this reason, a period in which the modulated signal Ms becomes the H level is relatively long, and a duty ratio increases. On the other hand, a rising inclination of the signal As becomes moderate when the input voltage becomes lower than the medium value. For this reason, a period in which the modulated signal Ms becomes the L level is relatively short, and a duty ratio decreases.

For this reason, the modulated signal Ms becomes the following pulse density modulation signal. That is, the duty ratio of the modulated signal Ms is approximately 50% when the input voltage is the medium value, increases when the input voltage becomes higher than the medium value, and decrease when the input voltage becomes lower than the medium value.

The gate driver 533 turns on/off the transistor M3 based on the modulated signal Ms. That is, the gate driver 533 turns on the transistor M3 when the modulated signal Ms is an H level, and turns off thereof when the modulated signal Ms is an L level. The gate driver 534 turns on/off the transistor M4 based on a logical inversion signal of the modulated signal Ms. That is, the gate driver 534 turns off the transistor M4 when the modulated signal Ms is the H level, and turns on thereof when the modulated signal Ms is the L level.

Accordingly, since a voltage of the driving signal COM-A which is obtained by smoothing an amplified-modulated signal in the connecting point of the transistors M3 and M4 using the inductor L2 and the capacitor C10 increases when the duty ratio of the modulated signal Ms increases, and decreases when the duty ratio of the modulated signal Ms decreases, as a result, the driving signal COM-A is controlled so as to be a signal which increases a voltage of the analog signal Aa, and is output.

Since the driving circuit 50 uses a pulse density modulation, there is an advantage that it is possible to obtain a large variation width of the duty ratio, compared to a pulse width modulation in which a modulation frequency is fixed.

That is, since a minimum positive pulse width and negative pulse width which can be treated in the entire circuit are restricted due to circuit characteristics thereof, in a pulse width modulation with a fixed frequency, it is possible to secure only a predetermined range (range, for example, from 10% to 90%) as a variation width of the duty ratio. In contrast to this, in the pulse density modulation, since the oscillating frequency decreases when the input voltage is far from the medium value, in a region in which the input voltage is high, it is possible to further increase the duty ratio, and in a region in which the input voltage is low, it is possible to further decrease the duty ratio. For this reason, in the self-excited oscillation-type pulse density modulation, it is possible to secure a wide range (for example, from 5% to 95%) as the variation width of the duty ratio.

The driving circuit 50 is the self-excited oscillation type, and a circuit which generates a carrier wave of a high frequency like separately-excited oscillation is not necessary. For this reason, there is an advantage that it is easy to integrate portions other than a circuit which treats a high voltage, that is, a portion of the LSI 500.

Moreover, in the driving circuit 50, since there is a path for feeding back a high frequency component through the pin Ifb, as a feedback path of the driving signal COM-A, not only a path through the pin Vfb, it is possible to reduce a delay in the entire circuit. For this reason, since a frequency for self-excited oscillation increases, the driving circuit 50 can generate the driving signal COM-A with good accuracy.

Figure 12:
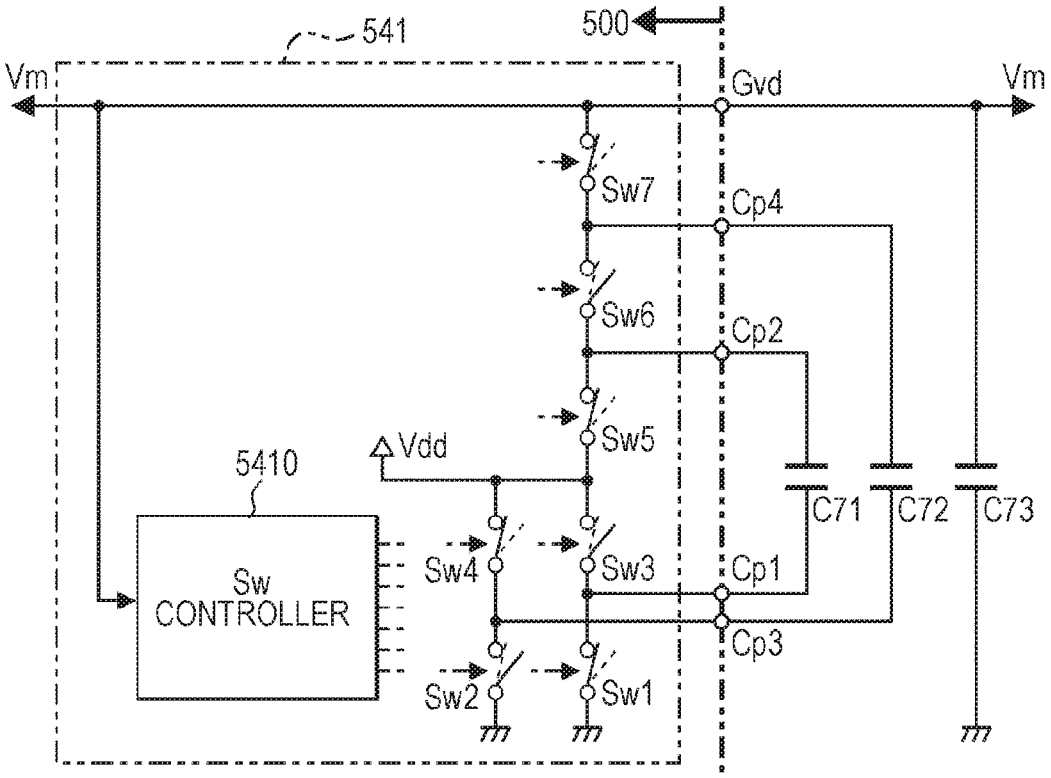
FIG. 12 is a diagram which illustrates a configuration of a boosting circuit in the driving circuit.

FIG. 12 is a diagram which illustrates an example of the boosting circuit 541 in the driving circuit 50.

The boosting circuit 541 illustrated in the figure includes a switch (Sw) controller 5410, and switches Sw1 to Sw7 of one pole single-throw type, and has a configuration in which the switch controller 5410 controls ON/OFF of the switches Sw1 to Sw7, respectively.

In the switches Sw1 to Sw7, and the capacitors C71, C72 and C73, when a terminal on the upper side in the figure is referred to as one end, and a terminal on the lower side is referred to as the other end, for convenience, the voltage Vdd of 3.3 V is applied to one end of the switch Sw3, one end of the switch Sw4, and the other end of the switch Sw5.

The other end of the switch Sw3 is connected to the other end of the switch Sw1, and the other end of the capacitor C71 through the pin CP1. The other end of the switch Sw1 is grounded. The other end of the switch Sw4 is connected to one end of the switch Sw2, and the other end of the capacitor C72 through the pin Cp3. The other end of the switch Sw2 is grounded.

One end of the switch Sw5 is connected to the other end of the switch Sw6, and one end of the capacitor C71 through the pin Cp2. One end of the switch Sw6 is connected to the other end of the switch Sw7, and one end of the capacitor C72 through the pin Cp4.

The other end of the switch Sw7 is an output end of the boosting circuit 541. For this reason, a voltage in the other end of the switch Sw7 is output to the voltage generating circuit 543 of the LSI 500 and the gate driver 534 as Vm, and is connected to one end of the capacitor C72 through the pin Gvd, and the electrode of the diode D2 (refer to FIG. 10).

The ON/OFF of the switches Sw1 to Sw7 enters the following two states. In detail, there are a first state in which the switches Sw1, Sw4, Sw5, and Sw7 enter the ON state, and the switches Sw2, Sw3, and Sw6 enter the OFF state, as denoted by a solid line in FIG. 12, and a second state in which the switches Sw1, Sw4, Sw5, and Sw7 enter the OFF state, and the switches Sw2, Sw3, and Sw6 enter the ON state, as denoted by a dashed line.

The switch controller 5410 alternately switches the first state and the second state at a predetermined interval, in a case in which the voltage Vm becomes a threshold value or less, and on the other hand, the switch controller stops switching of the first state and the second state, in a case in which the voltage Vm exceeds the threshold value.

Figure 13A:
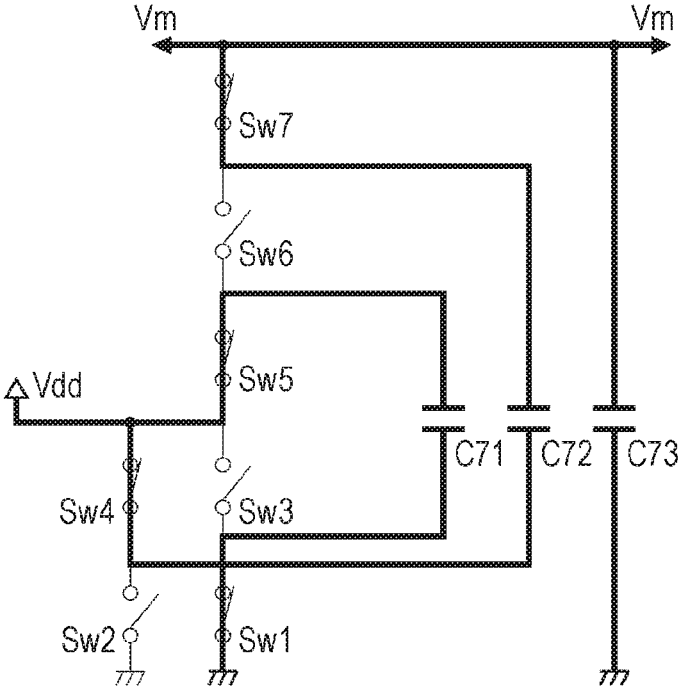
FIG. 13A is a diagram which describes operations of the boosting circuit.

FIG. 13A is a diagram which illustrates a connection in the first state in the boosting circuit 541, and simply illustrates a path for an electrical connection which is formed, using ON of a switch.

As illustrated in the figure, in the first state, the capacitor C71 holds the voltage Vdd by charging one end so as to be a high potential, and on the other hand, the capacitor C72 raises a voltage which is held till then to the voltage Vdd in the other end, and outputs thereof as the voltage Vm in one end.

Figure 13B:
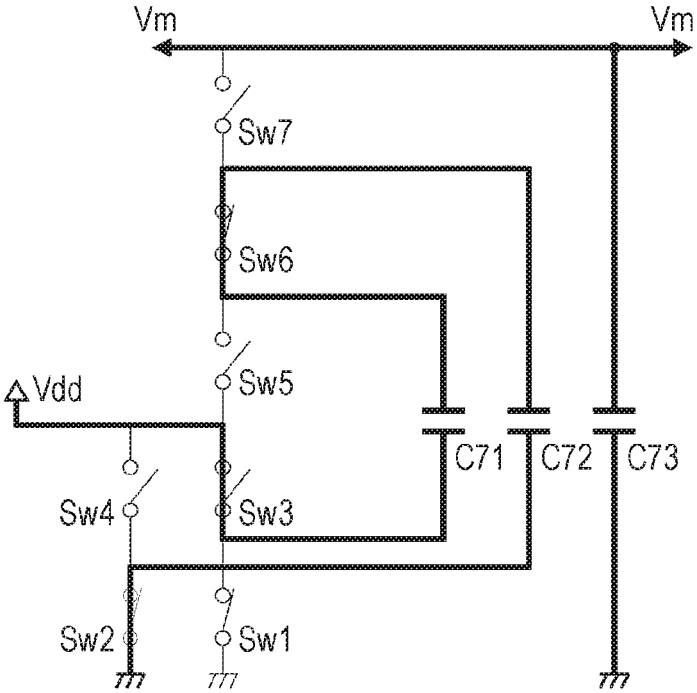
FIG. 13B is a diagram which describes operations of the boosting circuit.

FIG. 13B is a diagram which simply illustrates a connection in the second state in the boosting circuit 541.

As illustrated in the figure, in the second state, the capacitor C71 raises the voltage Vdd which is held till then to the voltage Vdd in the other end, and moves thereof to the capacitor C72 of which the other end is grounded. For this reason, the capacitor C72 holds a voltage 2 Vdd having one end as a high potential.

When it is the first state again, since the other end of the capacitor C72 is raised to the voltage Vdd, a voltage in one end of the capacitor C72 becomes 3 Vdd. The voltage 3 Vdd is output as the voltage Vm, and is held in the capacitor C73. In the second state, a holding voltage of the capacitor C73 is output as the voltage Vm.

Figure 14:
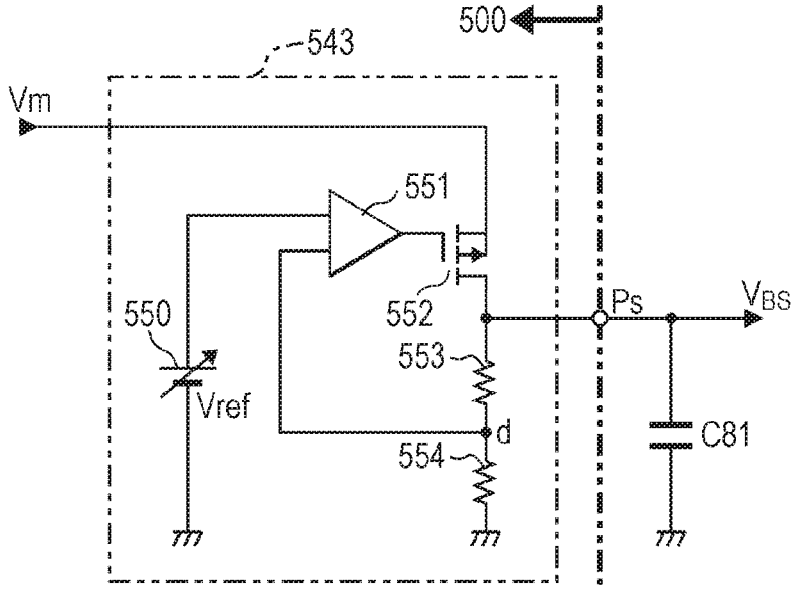
FIG. 14 is a diagram which illustrates a configuration of a voltage generating circuit.

FIG. 14 is a diagram which illustrates an example of the voltage generating circuit 543 in the driving circuit 50.

The voltage generating circuit 543 illustrated in the figure includes a reference power supply 550, an arithmetic circuit 551, a transistor 552 of a P-channel, for example, and resistors 553 and 554.

Among these, the reference power supply 550 outputs a reference voltage Vref. The arithmetic circuit 551 inputs the reference voltage Vref, and a voltage of a terminal d, outputs a voltage corresponding to a difference between the voltages, and applies thereof to a gate terminal of the transistor 552. The voltage Vm using the boosting circuit 541 is applied to a source terminal of the transistor 552, and a drain terminal of the transistor 552 is connected to a pin Ps and one end of the resistor 553. For this reason, the drain terminal of the transistor 552 is set to an output terminal of the voltage $V_{BS}$. In addition, as described above, the capacitor C81 as the external component is electrically interposed between the pin Ps and the ground.

The arithmetic circuit 551 is configured so that an output voltage decreases (voltage between gate electrode and source electrode increases) when a voltage of the terminal d decreases further than the reference voltage Vref.

In the voltage generating circuit 543, since a resistance between the source terminal and the drain terminal of the transistor 552 decreases when the voltage $V_{BS}$ decreases, and a voltage of the terminal d is lower than the voltage Vref, the voltage Vm is controlled so that the voltage $V_{BS}$ which is divided by the transistor 552, and a series connection of the resistors 553 and 554 is increased. In contrast to this, since the resistance between the source terminal and the drain terminal of the transistor 552 increases when the voltage $V_{BS}$ increases, it is controlled so that the voltage $V_{BS}$ is decreased.

Accordingly, the voltage $V_{BS}$ balances by using a voltage corresponding to the reference voltage Vref. However, in practice, since an output response in the voltage generating circuit 543 is not sufficiently high, the capacitor C81 is provided so as to back the voltage $V_{BS}$ up.

In addition, it may be a configuration in which the voltage generating circuit 543 monitors the voltage $V_{BS}$ (or, voltage of terminal d), and when the voltage $V_{BS}$ is shifted from a target voltage by a predetermined value (for example, +/−1 V) or more, the control section 100, or the like, is informed of the error.

As described above, the capacitors C71 and C72 are external components with respect to the LSI 500 which includes the boosting circuit 541 or the voltage generating circuit 543. The LSI 500, and the capacitors C71 and C72 configure a part of the driving circuit 50 by being mounted on a printed circuit board.

Figure 15:
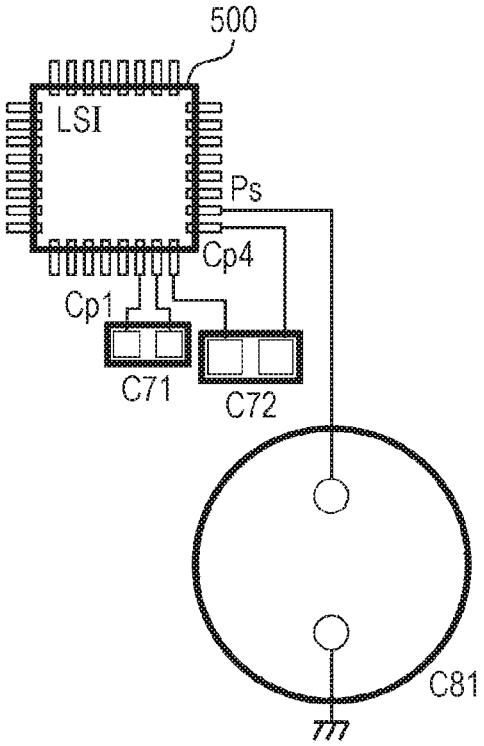
FIG. 15 is a diagram which describes a positional relationship in various capacitors with respect to an LSI.

FIG. 15 is a diagram which illustrates an example of disposing of the LSI 500 and the capacitors C71, C72, C73, and C81 on the printed circuit board. In addition, FIG. 15 illustrates a state when the printed circuit board is planarly viewed, by facing a mounting face of components. In the LSI 500, components other than the capacitors C71, C72, and C81 are omitted.

As illustrated in FIG. 15, the LSI 500 is a surface-mounted quad flat package (QFP) in which input-output leads protrude from each of four sides. The capacitors C71 and C72 are chip capacitors which are approximately rectangular, and both ends thereof are set to connecting leads, and the capacitor C81 is formed in a cylindrical shape, and is a surface-mounted electric field capacitor in which two connecting leads are provided on a bottom face.

As illustrated in the figure, the capacitors C71 and C72 are disposed with respect to the LSI 500 so as to be closer than the capacitor C81.

The capacitors C71 and C72 are capacitors for a charge pump which is used when boosting the voltage Vdd three times in the boosting circuit 541, and are alternately switched between the first state illustrated in FIG. 13A and the second state illustrated in FIG. 13B. In a case in which any measure is not provided, a problem that noise easily occurs at a time of switching is pointed out; however, according to the embodiment, since the capacitors C71 and C72 are disposed in the vicinity of the LSI 500, an influence of impedance of a wiring pattern in the printed circuit board is reduced, and a stable operation of the circuit is obtained.

Meanwhile, since the capacitor C81 is not accompanied by switching, the capacitor is rarely influenced by the wiring pattern in the printed circuit board, compared to the capacitors C71 and C72. In addition, since the capacitor C81 is provided in order to stabilize the voltage Vm which is generated by the voltage generating circuit 543, the capacitor has a large capacity compared to the capacitors C71 and C72.

In addition, when considering a functional block of the LSI 500, in a relationship in which the voltage generating circuit 543 uses an output voltage of the boosting circuit 541, the boosting circuit 541 which uses the capacitors C71 and C72, and the voltage generating circuit 543 which uses the capacitor C81 are disposed so as to be close to each other (which will be described later). Accordingly, in the LSI 500, the pins Cp1 to Cp4 as the bare chip, and the lead which is extracted from the Ps using wire bonding are also close. Accordingly, it is necessary to dispose the capacitors C71, C72, and C81 so as to be close at the periphery of the LSI 500. As a matter of course, it is necessary to dispose a lot of components such as the capacitors, and the resistors which are illustrated in FIG. 10 at the periphery of the LSI 500, in addition to those. For this reason, according to the embodiment, efficient disposing of components in a limited substrate area, and stabilizing of the circuit are made compatible, by preferentially disposing the capacitors C71 and C72 in the vicinity of the LSI 500, and subsequently disposing the capacitor C81.

Figure 16:
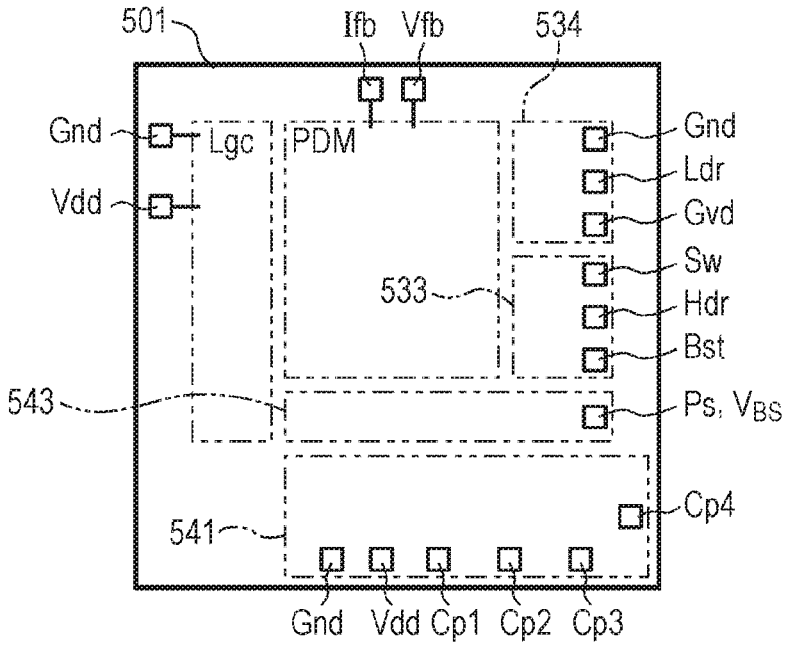
FIG. 16 is a diagram which illustrates a circuit region, or the like, of a bare chip of the LSI.

FIG. 16 is a plan view which simply illustrates disposing of each circuit region, and each of pad electrodes which are formed in a bare chip 501 of the LSI 500. The bare chip 501 is wire-bonded to lead, and is molded using a resin, thereby forming the LSI 500.

In the figure, a plurality of pad electrodes which are formed in a small square shape are provided in edge ends of the bare chip 501 which is formed in a large square shape. Between the pad electrode and the QFP lead (refer to FIG. 15) is radially connected using wire bonding. For this reason, disposing of the QFP lead in FIG. 15 is approximately similar to a radial shape in disposing of pins in FIG. 16, and may be considered to be the same.

In the bare chip 501, the boosting circuit 541 is provided in a long rectangular region which goes along one side of four sides, and the voltage generating circuit 543, and the gate drivers 533 and 534 are provided along one side which is orthogonal to the above described one side. For this reason, the pins (leads) Cp1 to CP4 in which the boosting circuit 541 is involved, in particular, the pin Cp4 to which one end of the capacitor C72 is connected, and the pin Ps in which the voltage generating circuit 543 is involved are close to each other.

A circuit PDM which extends from the DAC 502 having a power supply of 3.3 V with a low amplitude to the NOT circuit 522 is provided in the bare chip 501 on a side which faces one side on which the boosting circuit 541 is provided.

The circuit PDM is provided so as to be close to the voltage generating circuit 543 and gate drivers 533 and 534.

A circuit Lgc which generates other logical signals such as clock is provided in a long rectangular region of the bare chip 501 which goes along the other side which is orthogonal to the one side on which the boosting circuit 541 is provided.

As described above, the boosting circuit 541 is apt to be a noise source, comparatively, since the boosting circuit performs boosting using switching in which the capacitors C71 and C72 are used; however, in contrast to this, the voltage $V_{BS}$ which is generated by the voltage generating circuit 543 is stable, since the voltage is approximately a constant voltage. Since the boosting circuit 541 as the noise source is located by interposing the stable voltage generating circuit 543 with respect to the circuit PDM, and the gate drivers 533 and 534 in the bare chip 501, it is a configuration in which it is difficult to propagate the noise due to the boosting circuit 541 to the circuit PDM, and the gate drivers 533 and 534, and it is possible to stabilize operations in the class D amplification.

The driving circuit 50 which generates the driving signal COM-A has been described as an example; however, the same circuit is adopted also in the driving circuit 50 which generates the driving signal COM-B.

The invention is not limited to the above described embodiment, and it is possible to adopt various modifications which will be described below, for example. It is also possible to adopt one modification which is arbitrarily selected, or appropriately combine a plurality of modifications, in the various modifications which will be described below.

In the embodiment, the driving circuit 50 has a configuration in which the driving signal COM-A (COM-B) which is obtained by smoothing an amplified-modulated signal using the low pass filter is fed back, when generating a modulated signal Ms; however, the modulated signal Ms itself may be fed back. For example, though it is not particularly illustrated, it may be a configuration in which an error between the modulated signal Ms and the input signal As is calculated, a signal in which the error is delayed and a signal Aa as a target are added or subtracted, and a result thereof is input to the comparator 520.

Since the amplified-modulated signal which appears in the connecting point (pin Sw) of the transistors M3 and M4 is different from the modulated signal Ms only in logical amplitude, it may be a configuration of feeding back the amplified-modulated signal similarly to the modulated signal Ms, after attenuating the amplified-modulated signal, for example.

The LSI 500 has a configuration of corresponding to one channel of the driving signal COM-A (or COM-B) in one package; however, two channels of the driving signals COM-A and COM-B may be set to one package.

As a matter of course, the boosting circuit 541 and the voltage generating circuit 543 may have a circuit configuration other than those illustrated in FIGS. 12 and 14. For example, in a case of boosting using the boosting circuit 541, capacitors other than the capacitors C71 and C72 may be used.

According to the embodiment, a configuration in which the driving signals COM-A and COM-B of two systems which are individually generated by the two driving circuits 50 are selected by the selecting unit 230 (or, not selected), and are supplied to one end of the piezoelectric element 60 is adopted; however, it may be a configuration in which, for example, four trapezoidal waveforms are repeated in a driving signal of one system, any one, or a plurality of waveforms are combined according to a size of a dot which is regulated in the data signal Data, and is supplied to one end of the piezoelectric element 60.

It is not necessary to align the transistors M3 and M4 as N-channel transistors, and for example, the transistor M3 on the high side may be set to a P-channel transistor, and both of the transistors may be set to P-channel transistors.

A printing apparatus has been exemplified as the liquid ejecting apparatus in the embodiment; however, the apparatus may be a three-dimensional modeling apparatus (so-called 3D printer) which performs three-dimensional modeling by ejecting liquid, a textile printing apparatus which dyes cloth by ejecting liquid, or the like.

The piezoelectric element 60 has been exemplified as a driving target of the driving circuit 50; however, when considering the driving circuit 50 separately from the printing apparatus, as the driving target, all of loads which include capacitive components such as an ultrasonic motor, a touch panel, an electrostatic speaker, a liquid crystal panel, for example, can be applied, without being limited to the piezoelectric element 60.

What is claimed is:

1. A driving circuit for driving a capacitive load, comprising:

a modulation circuit which generates a modulated signal obtained by performing pulse modulation with respect to a source signal as a source of a driving signal;

a boosting circuit which outputs a voltage boosted by at least a first capacitor;

a gate driver in which the voltage boosted by the boosting circuit is used as a power supply, and which generates a control signal based on the modulated signal;

a pair of transistors which generates an amplified-modulated signal based on the control signal;

a low pass filter which generates a driving signal which is applied to the capacitive load by smoothing the amplified-modulated signal;

a voltage generating circuit which applies an offset voltage to an electrode which is different from an electrode to which the driving signal of the capacitive load is applied, from an output terminal; and a second capacitor of which one end is electrically connected to the output terminal of the voltage generating circuit, wherein at least the boosting circuit and the voltage generating circuit are integrated in an integrated circuit, and wherein a distance between the first capacitor and the integrated circuit is shorter than a distance between the second capacitor and the integrated circuit.

2. The driving circuit for driving a capacitive load, according to claim 1, wherein the integrated circuit includes a first terminal which is electrically connected to the first capacitor, and a second terminal which is electrically connected to the second capacitor, and wherein a distance between the first capacitor and the first terminal is shorter than a distance between the second capacitor and the second terminal.

3. The driving circuit for driving a capacitive load, according to claim 2, wherein the first terminal and the second terminal are located so as to be close to each other.

4. The driving circuit for driving a capacitive load, according to claim 3, wherein, in the integrated circuit, a region in which the boosting circuit is formed and a region in which the voltage generating circuit is formed are close to each other.

5. The driving circuit for driving a capacitive load, according to claim 1, wherein a frequency of the modulated signal is 1 MHz or more and 8 MHz or less.

* * * * *